US005174233A

United States Patent [19]

Nielsen

[11] Patent Number: 5,174,233

[45] Date of Patent: Dec. 29, 1992

[54] SELF ADJUSTING BOAT OUTRIGGER FLOAT

[76] Inventor: Wayne J. Nielsen, 7800 Van Buren St. NE., Spring Lake Park, Minn. 55432

[21] Appl. No.: 572,443

[22] Filed: Aug. 27, 1990

[51] Int. Cl.[5] ..... B63B 43/02

[52] U.S. Cl. ..... 114/123

[58] Field of Search ..... 114/56, 57, 61, 39.1, 114/123

[56] References Cited

U.S. PATENT DOCUMENTS 2,347,959 5/1944 Moore et al. ..... 114/61

3,002,484 10/1961 Dube ..... 114/61

3,517,632 6/1970 Gray ..... 114/61

3,981,259 9/1976 Harper ..... 114/61

FOREIGN PATENT DOCUMENTS 39994 4/1981 Japan ..... 114/39.2

*Primary Examiner*—Jesus D. Sotelo

*Assistant Examiner*—Stephen P. Avila

[57] ABSTRACT

A self-adjusting boat outrigger pontoon float having a forward declining shock absorbing strut which pivotally receives a pontoon float, and offers a mechanical advantage for offsetting the forces induced by water wave action.

6 Claims, 5 Drawing Sheets

SELF ADJUSTING BOAT OUTRIGGER FLOAT

BACKGROUND OF THE INVENTION

The present invention relates generally to the art of water vessels and particularly to the art of stabilizing these crafts. In this art it is beneficial to stabilize the rocking, listing motion of water craft such as canoes for comfort and handling.

Techniques, such as floats, pontoons, and rudders or keel boards positioned along side of the water craft have typically been used for this purpose and are therefore old and well known to the art. The common problem with this is that there has never been a floatation device that follows the movement and fluctuation of the water and its waves as well as the change of direction of the water craft itself. No flotation devices have been specifically designed and suited for this.

Devices presently available address stabilization through the addition of floatation devices and or rudder devices. These devices were designed more than 100 years ago. Improvements were made to these devices approximately 20 years ago in the way of clamping supports, accessories that can be utilized, materials that can be utilized, and systematic controls. The problem with these previous devices is that they do not provide the ability to articulate while providing the ability to follow the motion of the water and its wave action with a movement dampening feature.

The present invention represents a major advance in the art of stabilizing water craft. The present invention provides an adjustable device which provides the ability to articulate while providing a movement dampening feature along with its ability to follow the motion of the water and its wave action with a device that offers a mechanical advantage.

A limited number of patents have been found which relate to the present invention. On such patent is U.S. Pat. No. 67,846 issued to Cayce on Aug. 20, 1867. Cayce discloses a pontoon float held in position along side a boat and employs springs in the supportive structure set up in such a way as to maintain a downward force against the water. U.S. Pat. No. 3,232,261 issued to Graig on Feb. 1, 1966 discloses a pontoon float depending down toward the water at an angle. The problem with this is that together, these two patents do not show how to use the spring at an angle to offer a mechanical advantage and a shock absorbing system or a means of articulation for directional self adjustment.

Other patents of interest are U.S. Pat. Nos. 3,763,813 by Holtz issued Oct. 9, 1973, 3,777,690 by Garber issued Dec. 11, 1973, 4,512,277 by Williams issued Apr. 23, 1985, 4,616,591 by Minor issued Oct. 14, 1986, 4,807,551 by Ace issued Feb. 28, 1989, 4,516,941 by Reid issued May 14, 1985, and 4,862,818 by Sullivan issued Sep. 5, 1989. These patents disclose various clamping and supportive structures which adjust for various height and size boats, accesories such as motor mounting, and mounting of an oar paddle for use as a keel board. However, none of these disclose a pontoon float which directionally articulates while employing a shock absorbing suspension system mounted in such a way that a mechanical advantage is given to this suspension system and also offers a motor mounting.

SUMMARY OF THE INVENTION

An advantage of the present invention is that it provides a directionally articulated pontoon float especially suited for aid in handling a water craft.

Another advantage of the present invention is the shock absorbing adjustable feature which allows it to maintain a downward resistive force on the water with a minimal effort offsetting the greater induced force created by the water wave action.

Another advantage of the present invention is its contouring feature of the pontoon float which by way of the curvature, creates a rudder keel effect when the water vessel is in motion and which provides a flat bottom and rounded front especially suited for prevention of float nose dives.

The general operation of the present invention is described herein to provide an understanding of the overall invention. A support arm is clamped to each side of a canoe, and extends beyond at least one side. At the outer end of the support arm, a forward declining strut is mounted, which declines forward and down toward the water at an angle of approximately 45 degrees. A float is mounted at the lower end of the strut by means of a ball joint which is positioned under the forward declining strut. The strut consists of a telescopic section which includes a spring and also features an air orificed chamber which works as a shock absorber.

When the boat lists to the float side, the force of the water must overcome the geometrical disadvantage it has to oppose the shock absorber. The water force multiplied by the sine of the angle equals the shock absorbers force. As the boat is turned farther and farther such as when a person might try to climb in, the offsetting force created by the shock absorber increases.

When the boat lists to the side opposite the float, the weight of the outrigger works to counteract. In addition to this, the shock absorber extends quickly with full benefit of the spring force, to reset or make ready for the list back to the float side.

A feature of the present invention is its ability to resist the force of the water with a minimal effort.

A further feature of the present invention is the variable force developed by the shock absorbing strut.

Another feature of the present invention is the mounting and the shape of the float which allows it to articulate and to work as a rudder keel while preventing it from taking nose dives.

An object of the present invention is to provide a device which is light weight, easy to handle and install, and is capable of stabilizing a canoe or other water vessel, while providing a means of mounting a prime mover so that the canoe can be propelled much faster than ever before.

It is anticipated that certain changes related to the size and shape of the present invention can be made without appreciably departing from the present invention. It is also anticipated that certain components may be joined together or integrated to offer a variety of advantages without departing from present invention.

DETAILED DESCRIPTION OF THE PREFERRED EMBODIMENT

Figure 1:
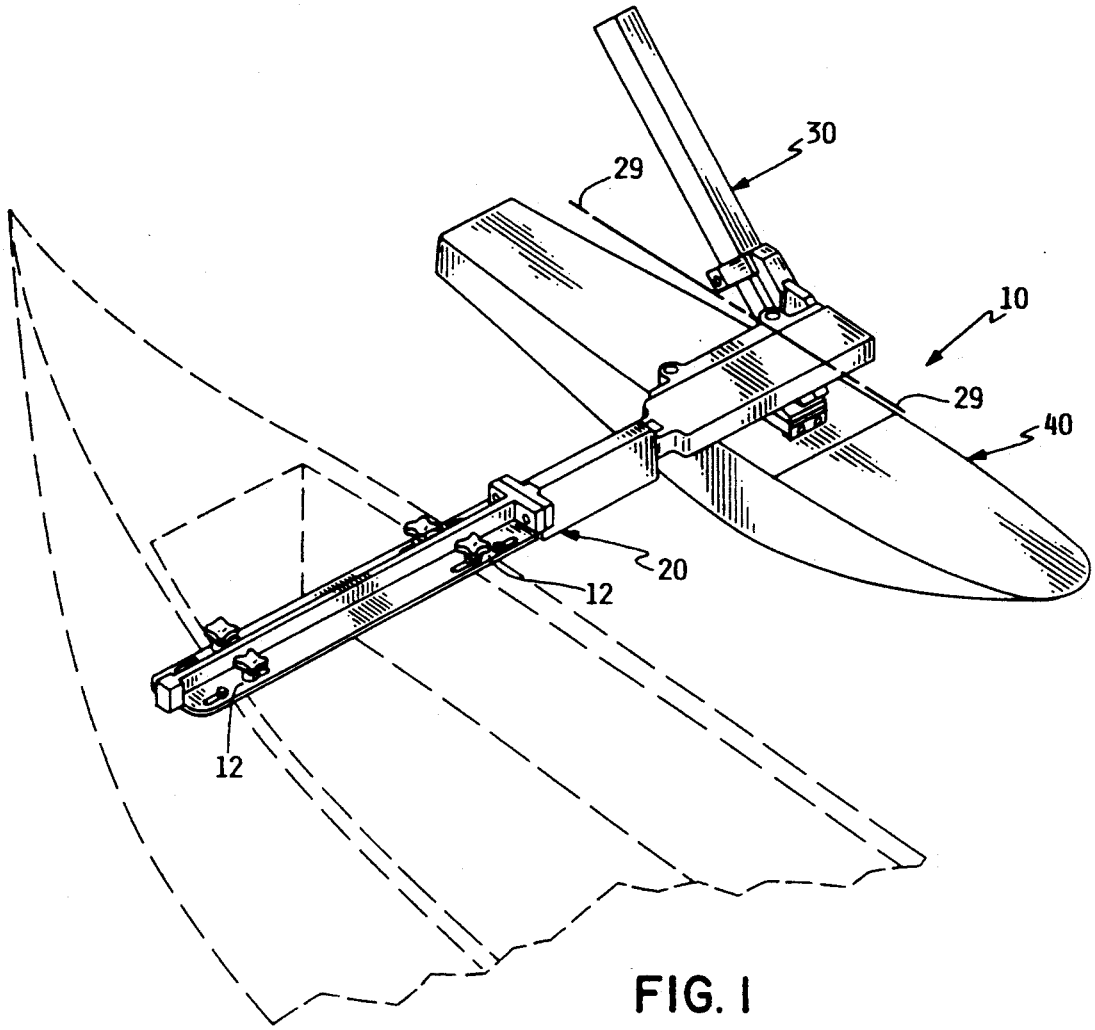
FIG. 1 is a perspective view of the present invention attached to a canoe.
Figure 2:
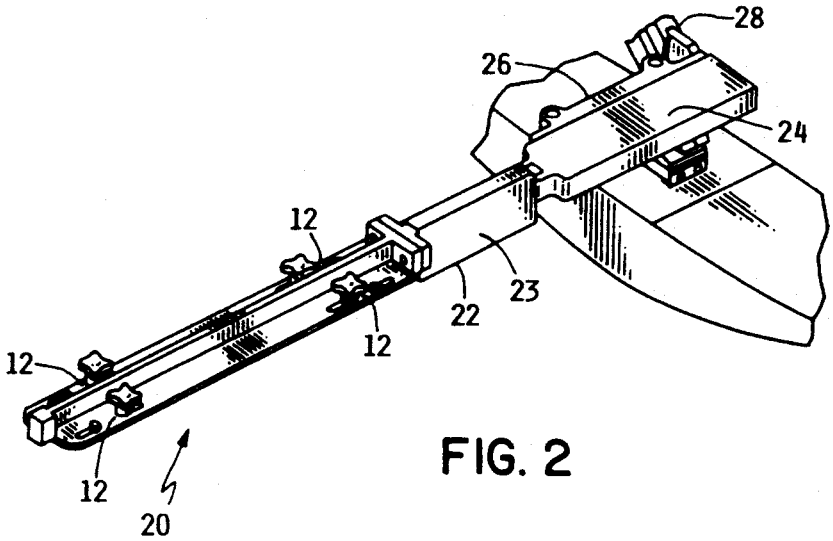
FIG. 2 is an enlarged perspective view of the support arm of the present invention.
Figure 3:
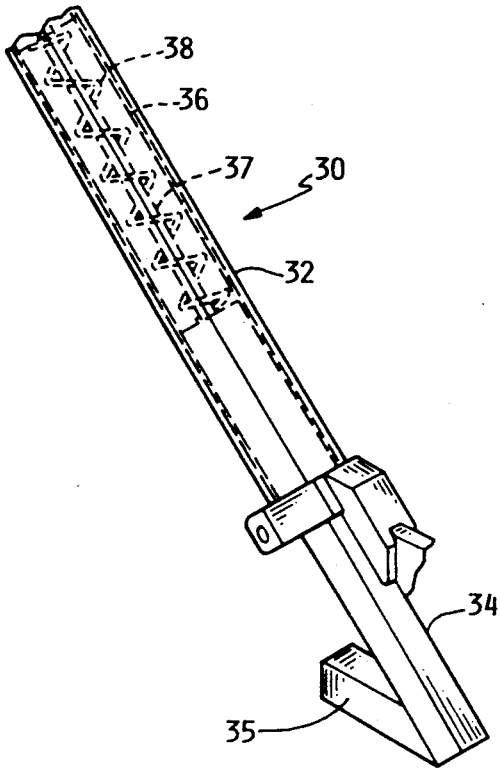
FIG. 3 is an enlarged perspective view of the shock absorbing strut as it is mounted to a pontoon float.
Figure 4:
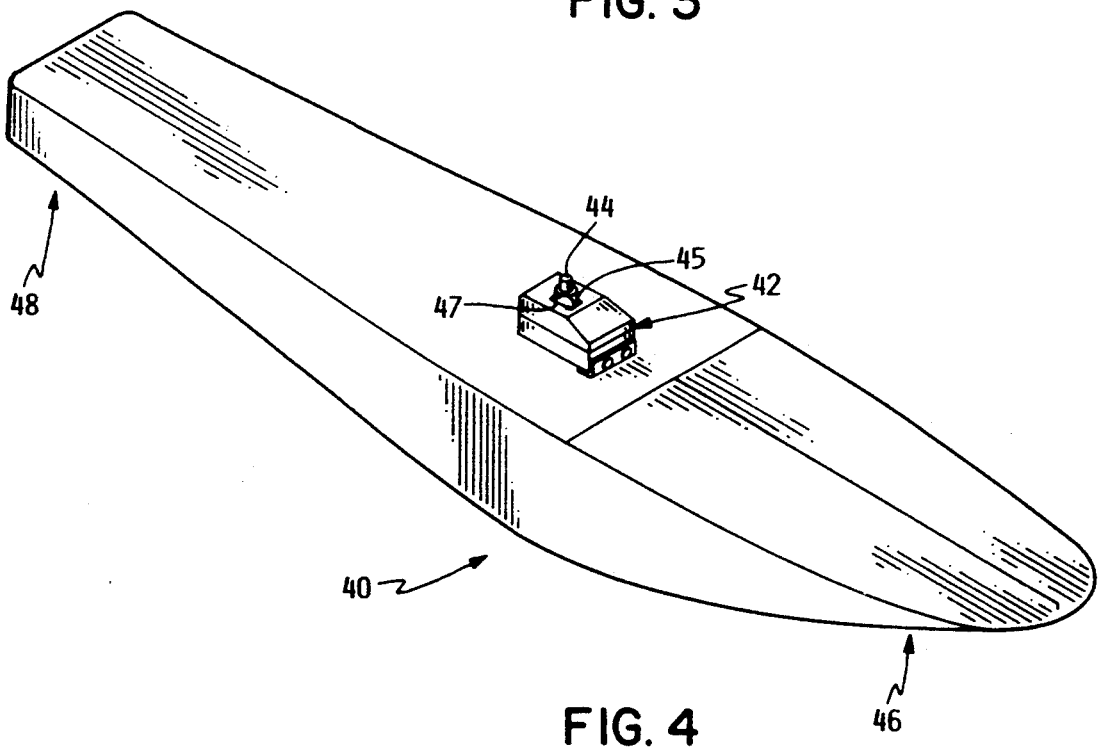
FIG. 4 is an enlarged perspective view of the float.
Figure 5:
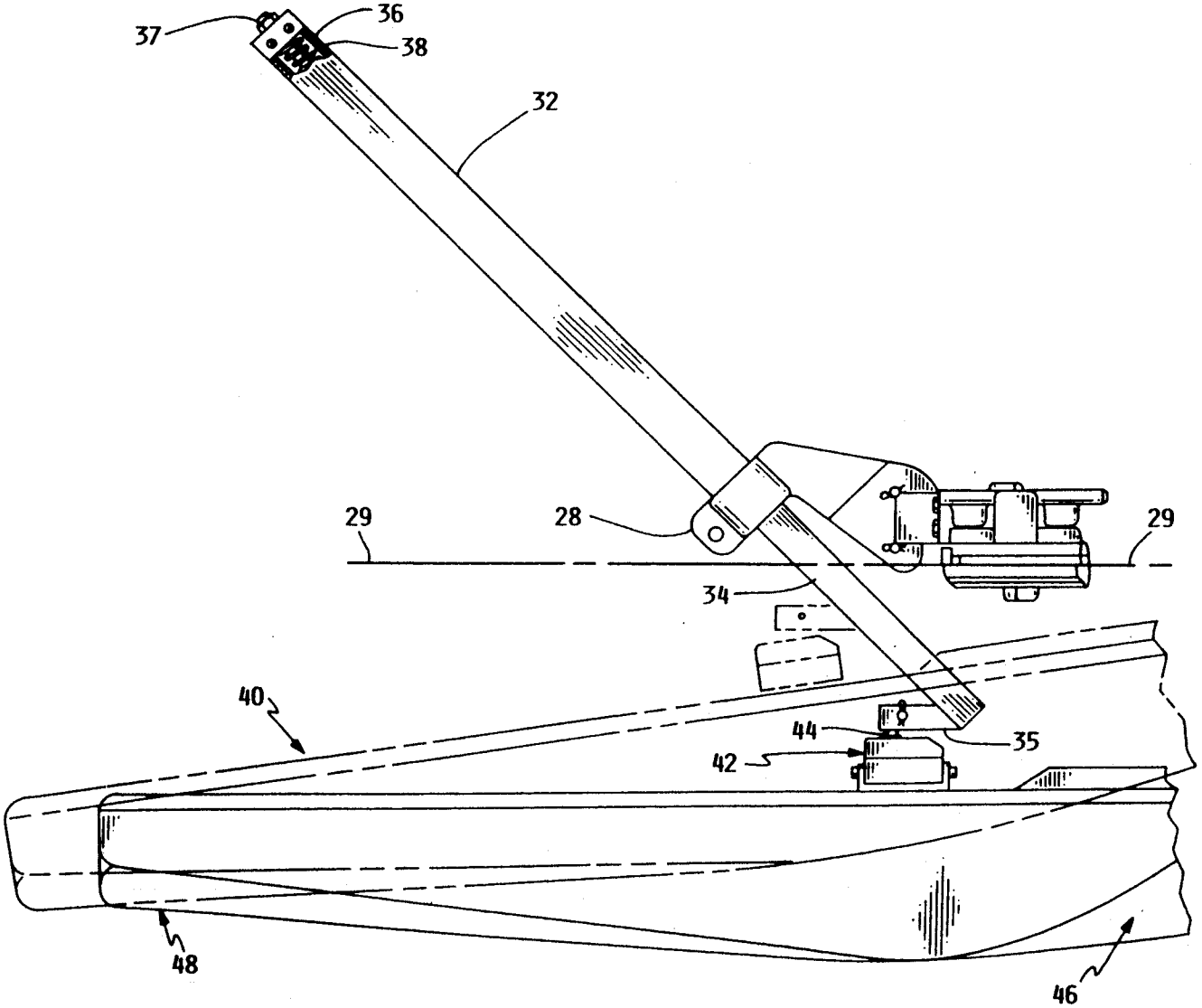
FIG. 5 is a cross sectional view of the strut and float assembly taken along line 5—5 of FIG. 3.
Figure 6:
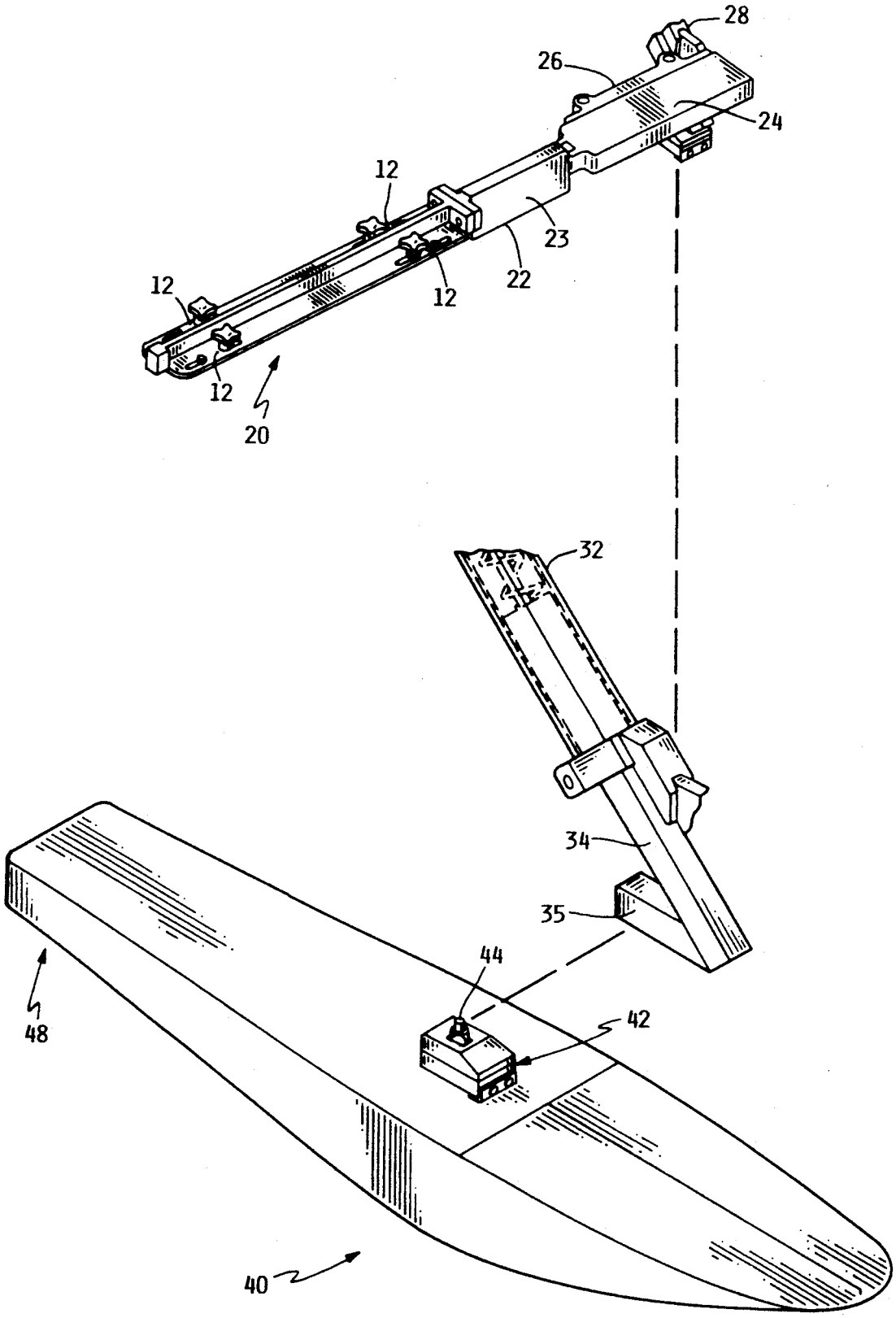
FIG. 6 is an exploded perspective view of the support arm, absorbing strut, and pontoon float assembly.
Figure 7:
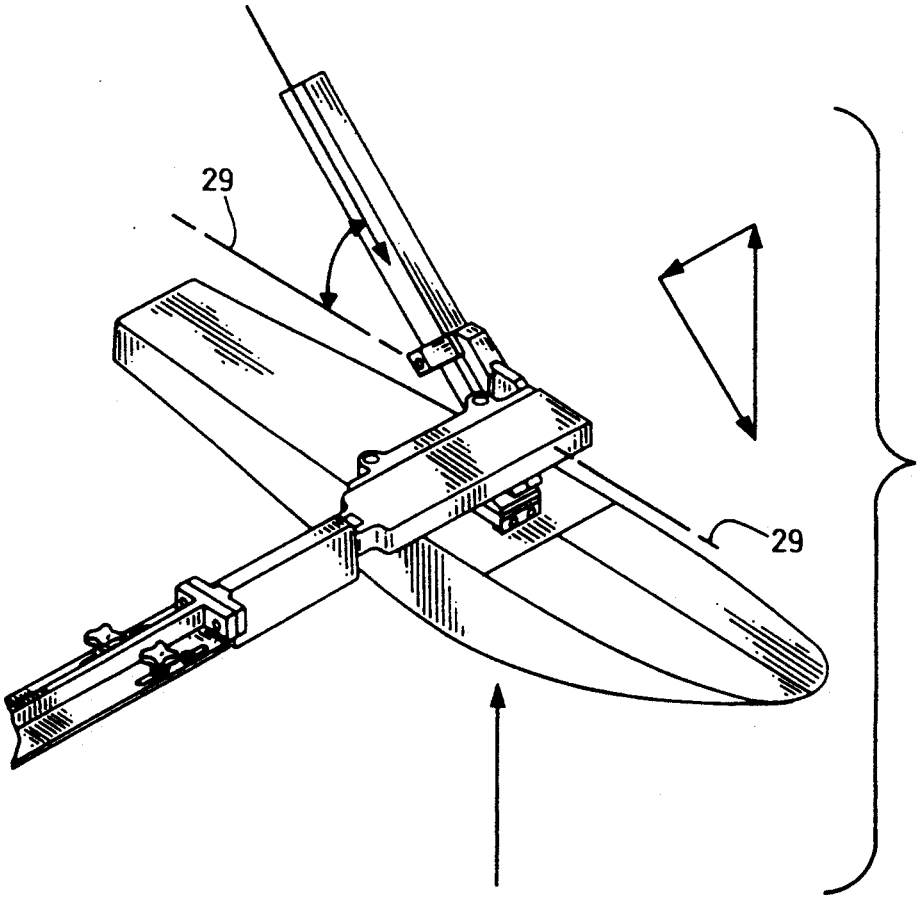
FIG. 7 is a geometric force illustration of the forces acting on the pontoon float.

The present invention herein is generally described as an outrigger, 10, consisting of a support arm, 20, a shock absorbing strut, 30, and a pontoon float, 40. The outrigger is detachably mounted to a canoe, 2, by clamping means, 12, located on the support arm.

The support arm, 20, in addition to the clamping means, 12, further comprises an inner support arm, 22, and an outer arm, 24, and an arm attachment, 26. A strut clamp, 28, is removeably fixed to the arm attachment, 26. The strut clamp, 28, receives and retains a strut in such a way that the strut is normal to the support arm, 20, and is at an angle to a horizontal reference line, 29, passing through the support arm, 20.

The inner support arm, 22, is twisted back so that its surface plane, 23, is preferrably at a slight angle from vertical and serves as a motor mount, which angle works to compensate for the front end of the boat coming up when propelling by keeping the motor normal to the general surface of the water.

The shock absorbing strut, 30, further comprises a cylinder housing, 32, and a cylinder tube, 34. The cylinder housing, 32, removably receives, cylinder liners, 36, cylinder rod, 37, and cylinder spring, 38. The cylinder tube, 34, is slideably received within the cylinder housing, 32, and its cylinder liners, 36. The cylinder tube, 34, is removably retained to the cylinder housing, 32, by the cylinder rod, 37, and the cylinder spring, 38, working circumferentially on the cylinder rod, 37, works to keep the cylinder tube, 34, normally extended.

The pontoon float, 40, is pivotally attached to the shock absorbing strut, 30, by a ball joint, 42. The ball joint allows free movement in any direction except as restricted by its mounting shank, 44. The pontoon float, 40, is rounded at its front end, 46, has a flat front bottom, and a taperring v-shaped back bottom, giving it a rudder-keel rear end, 48. The mounting shank, 44, is removably attached to an angle support, 35, formed onto the bottom end of the cylinder tube, 34. The mounting shank has at its lower end, a ball pivot, 45, which is pivottally retained by a slot, 47, which said slot, working against said shank, works to define the range of motion accomplished by said pontoon float.

When water wave action applies a force up on the pontoon float, 40, the cylinder spring, 38, along with air inside the cylinder housing, 32, work to provide a reactive force. This shock absorbing action, together with the weight of the outrigger working as a counterbalance reactive force for the opposite application forces, stabilize the water vessel. The angle of the shock absorbing strut, 30, give it a geometrical mechanical advantage allowing for a minimum of spring effort to react to the water force. The cylinder spring, 38, provides a variable force such that the farther it is displaced, the greater its reactive force is. The ball joint, 42, allows the pontoon float, 40, to work as a self directed rudder such that when turning left the pontoon float, 40, turns slightly to the right along with the propulsion motor and vice versa for right turns giving the canoe better control.

That which is claimed is:

1. A self-adjusting outrigger pontoon float assembly, comprising:

a support arm receiving a forward declining shock absorbing strut on an outer end and attaching to a watercraft on an inner end;

said forward declining shock absorbing strut including an outer housing, a spring, a rod within the spring, and an inner tube, said outer housing and inner tube being formed with a plurality of flat sides to prevent twisting motion therebetween;

a pivot joint joining the strut and an outrigger pontoon float; and, said pontoon float including a leading front end, a declining front bottom, and an inclining rear bottom to provide a rudder keel effect.

2. The assembly of claim 1, wherein:

the support arm further consists of an inner support arm, an outer support arm, an arm attachment, and clamping means.

3. The assembly of claim 2, wherein:

the arm attachment further provides means for removable attachment of a strut clamp.

4. The assembly of claim 2, wherein:

the inner support arm has a surface plane oriented at an angle from vertical and horizontal and provides a surface for mounting a motor.

5. The assembly of claim 1, wherein:

the watercraft includes an additional self-adjusting outrigger pontoon float assembly, the assemblies being located on either side of the watercraft.

6. The assembly of claim 1, wherein:

the pontoon float pivot joint includes a mounting shank, which said shank has at its lower end a pivot, which said pivot is pivotally retained by a slot, said slot working against said shank to define the range of motion of said pontoon float.

* * * * *